US006378507B1

(12) United States Patent
Gagnon

(10) Patent No.: US 6,378,507 B1
(45) Date of Patent: Apr. 30, 2002

(54) EXHAUST GAS RECIRCULATION VALVE HAVING AN ANGLED SEAT

(75) Inventor: Frederic Gagnon, Chatham (CA)

(73) Assignee: Siemens Canada Limited, Mississauga (CA)

( * ) Notice: Subject to any disclaimer, the term of this patent is extended or adjusted under 35 U.S.C. 154(b) by 0 days.

(21) Appl. No.: 09/692,416

(22) Filed: Oct. 20, 2000

Related U.S. Application Data

(60) Provisional application No. 60/160,605, filed on Oct. 20, 1999.

(51) Int. Cl.[7] ..... F02M 25/07

(52) U.S. Cl. ..... 123/568.11; 123/568.27

(58) Field of Search ..... 123/568.11, 568.16, 123/568.21, 568.26, 568.27, 568.28, 568.29; 137/907; 251/333, 334, 129.15

(56) References Cited

U.S. PATENT DOCUMENTS

| | | | | |
|---|---|---|---|---|
| 3,762,384 A | * | 10/1973 | Day et al. | 123/568.29 |
| 3,800,817 A | | 4/1974 | Gropp et al. | 137/242 |
| 4,009,700 A | | 3/1977 | Engels et al. | 123/568.27 |
| 4,566,423 A | * | 1/1986 | Kenny et al. | 123/568.27 |
| 5,241,940 A | * | 9/1993 | Gates, Jr. | 123/676 |
| 5,255,659 A | | 10/1993 | Choma | 123/568.29 |
| 5,511,531 A | | 4/1996 | Cook et al. | 123/568.21 |
| 5,613,479 A | * | 3/1997 | Gates, Jr. | 123/568.27 |
| 5,718,211 A | | 2/1998 | Halsall et al. | 123/568.11 |
| 6,116,224 A | * | 9/2000 | Cook et al. | 123/568.27 |
| 6,138,652 A | * | 10/2000 | Cook et al. | 123/568.27 |
| 6,170,476 B1 | * | 1/2001 | Cook et al. | 123/568.27 |
| 6,189,520 B1 | * | 2/2001 | Cook et al. | 123/568.27 |

FOREIGN PATENT DOCUMENTS

| | | |
|---|---|---|
| DE | 42 04 434 | 8/1993 |

* cited by examiner

*Primary Examiner*—Willis R. Wolfe

(57) ABSTRACT

A method of recirculating exhaust gas flow from an exhaust port to an intake port of an internal combustion engine, and an emission control valve assembly that regulates recirculating the exhaust gas flow. The emission control valve assembly comprises a valve body and a seat. The valve body has a passage that connects a first port to a second port. The passage has a first passage portion that extends from the first port along a first central axis, a second passage portion that extends from the second port along a second central axis, and a third passage portion that extends along a third central axis. The third passage portion connects the first and second passage portions at respective first and second points along the third axis. The seat extends along the third central axis and is located between the first and second points. The seat has a first rim that lies in a first plane oriented orthogonally with respect to the third central axis, and a second rim that lies in a second plane oriented obliquely with respect to the third central axis.

19 Claims, 4 Drawing Sheets

EXHAUST GAS RECIRCULATION VALVE HAVING AN ANGLED SEAT

Cross Reference to Co-Pending Applications

This application claims the benefit of the earlier filing date of U.S. Provisional Application No. 60/160,605, filed Oct. 20, 1999, the disclosure of which is incorporated by reference herein in its entirety.

FIELD OF THE INVENTION

This invention relates generally to automotive emission control valves, such as exhaust gas recirculation (EGR) valves that are used in emission control systems of automotive vehicles with internal combustion engines (I.C.E.). More specifically, the invention relates to a valve seat for an EGR valve that achieves a characteristic flow of the exhaust gas.

BACKGROUND OF THE INVENTION

In an EGR systems module (ESM) that includes an EGR valve, a transducer is used to measure a pressure differential across a valve orifice. This pressure differential is used to calculate exhaust gas flow through the EGR valve. In order to measure this pressure differential, static pressure ports are located upstream and downstream of the valve orifice.

The inventor of the claimed invention has discovered that a known ESM can exhibit a flow characteristic referred to as "curl back," which is illustrated in FIG. 1. Specifically, exhaust gas flow, which is measured as a function of the multiplication product of differential pressure (DP) and manifold absolute pressure (MAP), "curls back" at the ends of the representative curves. Thus, there is not a unique correspondence between the multiplication product (DP*MAP) and flow through the valve. As illustrated in FIG. 1, there may be two or more different flow values that correspond to a single DP*MAP value. Since DP*MAP is used by an engine control unit (ECU) to determine if the EGR valve should be opened or closed, the "curl back" characteristic of such a conventional EGR is a disadvantage. For example, the "curl back" characteristic can cause the ECU to determine a decreasing flow condition even though the EGR valve is opening, i.e., DP*MAP is decreasing while flow and duty cycle are increasing.

Thus, it is believed that there is a need to eliminate the "curl back" characteristic in exhaust flow through EGR valves.

SUMMARY OF THE INVENTION

The claimed invention provides an emission control valve assembly that comprises a valve body and a seat. The valve body has a passage that connects a first port to a second port. The passage has a first passage portion that extends from the first port along a first central axis, a second passage portion that extends from the second port along a second central axis, and a third passage portion that extends along a third central axis. The third passage portion connects the first and second passage portions at respective first and second points along the third axis. The seat extends along the third central axis and is located between the first and second points. The seat has a first rim that lies in a first plane oriented orthogonally with respect to the third central axis, and a second rim that lies in a second plane oriented obliquely with respect to the third central axis.

The claimed invention also provides an exhaust gas recirculation passage for an internal combustion engine. The passage comprises an inlet, an outlet, and an orifice between the inlet and the outlet. The orifice defines a portion of the passage and extends along a central axis between a first rim and a second rim. The first rim lies in a first plane oriented orthogonally with respect to the central axis, and the second rim lies in a second plane oriented obliquely with respect to the central axis.

The claimed invention further provides a method of recirculating an exhaust gas flow from an exhaust port to an intake port of an internal combustion engine. The method comprises providing a valve regulating the exhaust gas flow. The valve includes a body defining a passage between an inlet port and an outlet port. The body includes a seat and a valve. The seat is disposed along the passage and has a rim providing an outlet for the exhaust gas flow through the seat. The rim lies in a plane that is oriented obliquely with respect to a first axis. The valve reciprocates along the first axis with respect to the seat. The valve reciprocates between a first configuration that prohibits the exhaust gases from flow through the seat, and a second configuration that permits the exhaust gas to flow through the seat. And flowing the exhaust gas flow through the seat such that a multiplication product of manifold absolute pressure and differential pressure on opposite sides of the valve increases as the exhaust gas flow increases.

The claimed invention yet further provides a method of recirculating exhaust gas flow from an exhaust port to an intake port of an internal combustion engine. The method comprises providing a valve interposed between the exhaust and intake ports; measuring a differential pressure on opposite sides of the valve; measuring a manifold absolute pressure in the intake manifold; calculating a multiplication product of the differential pressure and the manifold absolute pressure; and determining a unique value of the exhaust gas flow for every multiplication product.

BRIEF DESCRIPTION OF THE DRAWINGS

The accompanying drawings, which are incorporated herein and constitute part of this specification, include one or more presently preferred embodiments of the invention, and together with a general description given above and a detailed description given below, serve to disclose principles of the invention in accordance with a best mode contemplated for carrying out the invention.

DETAILED DESCRIPTION OF THE PREFERRED EMBODIMENTS

Figure 2:
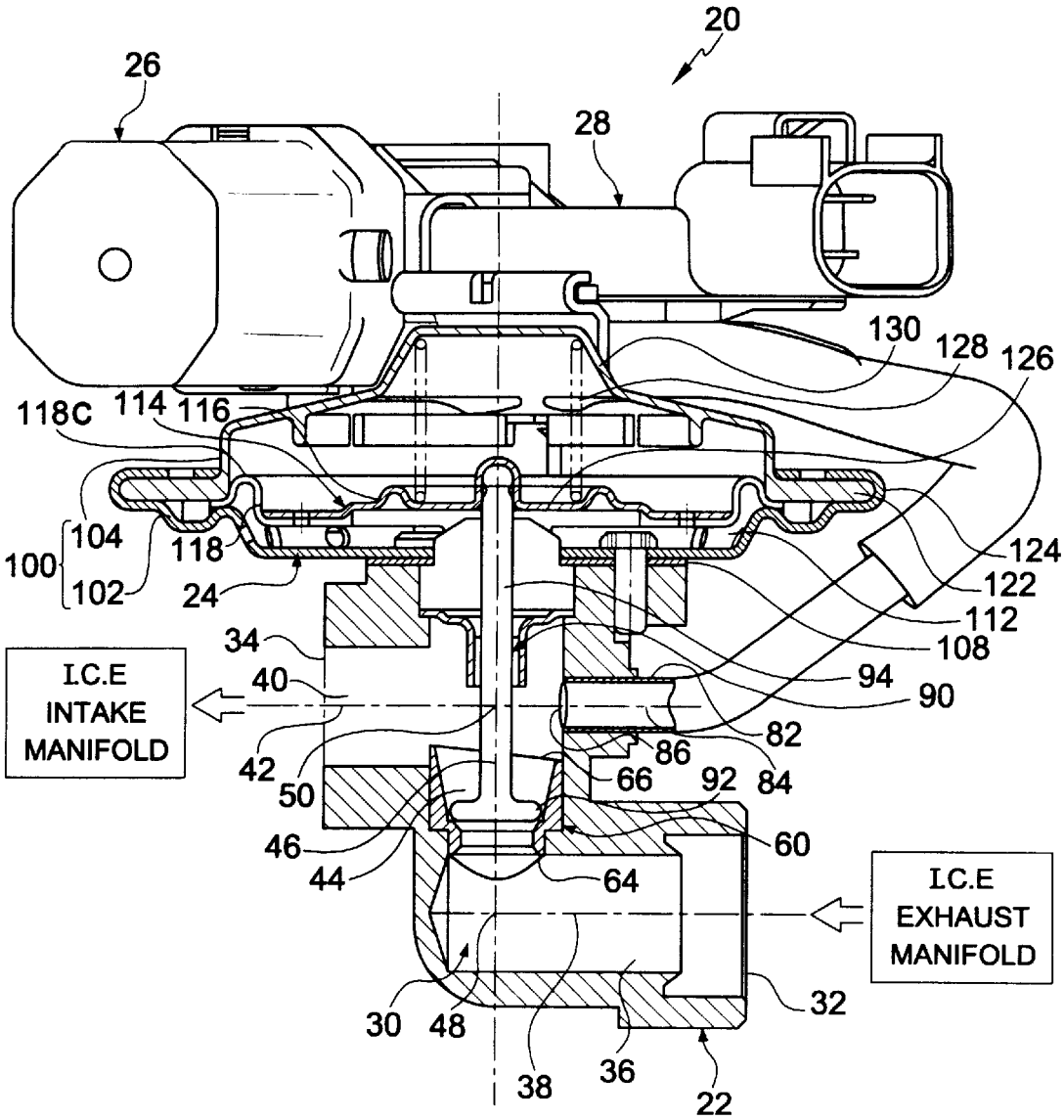
FIG. 2 is a front elevation view, partly in cross section, showing an exemplary ESM that includes an EGR valve according to the claimed invention.

Referring to FIG. 2, an ESM 20 comprises an EGR valve body 22, a fluid-pressure-operated actuator 24, an electric-operated vacuum regulator (EVR) valve 26, and a sensor 28 that provides an electric signal related to the magnitude of sensed vacuum. The construction, operation, and interrelationship of these features is more particularly described in U.S. Pat. No. 5,241,940 to Gates, Jr. and U.S. Pat. No. 5,613,479 to Gates et al., both of which are incorporated herein by reference.

Figure 1:
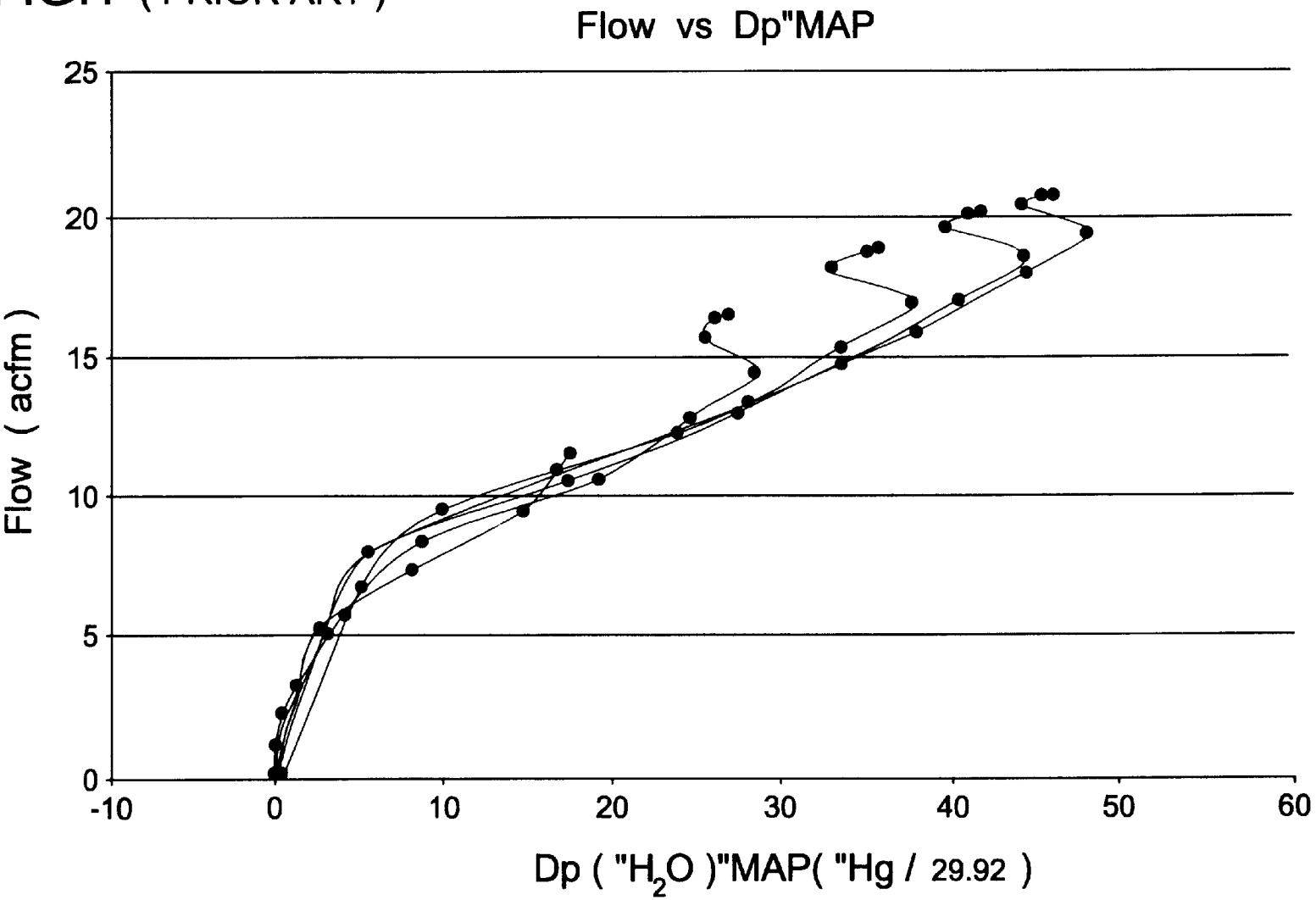
FIG.1 ( PRIOR ART )
FIG. 1 is a graph illustrating the "curl back" characteristic of exhaust gas flow through a conventional EGR valve.

The EGR valve body 22 comprises an internal flow passage 30 extending between an inlet port 32 and an outlet port 34. Passage 30 comprises a first passage portion 36 extending along a first central axis 38, a second passage portion 40 extending along a second central axis 42, and a third passage portion 44 extending along a third central axis 46. The third passage portion 44 connects to the first passage portion 36 at a first point 48 along the third axis 46, and connects to the second passage portion 40 at a second point 50 along the third axis 46. In the preferred embodiment illustrated in FIG. 1, the first and second axes lie in respective imaginary parallel planes that are spaced along and orthogonal to the third axis. Other relative arrangements of these axes are also possible within the scope of the claimed invention. For example, the first axis 38 can extend arcuately, the first axis 38 can obliquely intersect the third axis 46, or the first and third axes 38, 46 can be coaxial.

Figure 3:
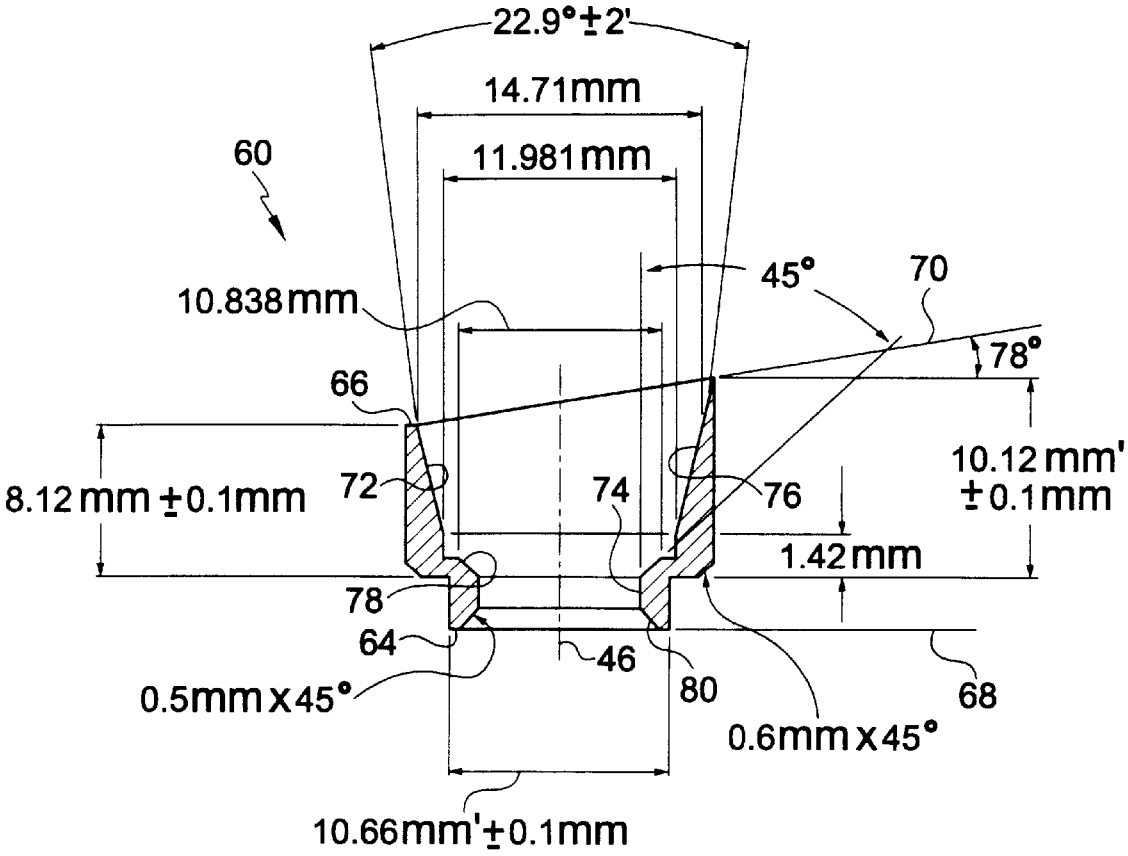
FIG. 3 is a cross-section view of a seat for the EGR valve shown in FIG. 2. The indicated dimensions are believed to be according to a preferred example of the claimed invention.
Figure 4:
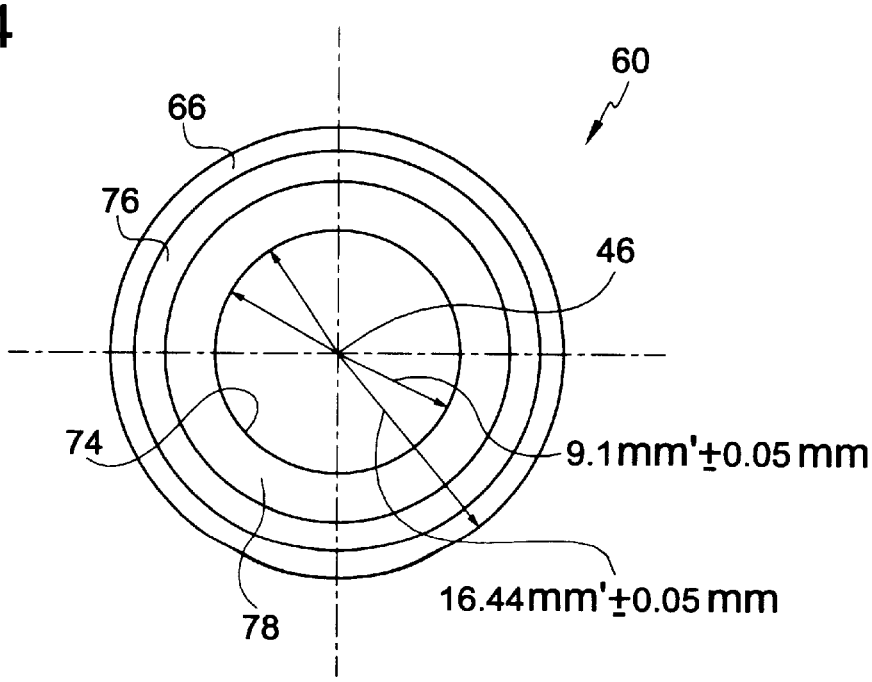
FIG. 4 is a plan view of the seat shown in FIG. 3. The indicated dimensions are believed to be according to a preferred example of the claimed invention.

An annular valve seat 60 is disposed in the third passage portion 44 along the third axis 46. Referring also to FIGS. 3 and 4, the seat 60, which is also referred to as an orifice, comprises an inlet rim 64 that is proximate the inlet port 32 and an outlet rim 66 that is proximate the outlet port 34. The inlet rim 64 lies in a first imaginary plane 68 that is oriented orthogonally with respect to the third axis 46. The outlet rim 66 lies in a second imaginary plane 70 that is oriented obliquely with respect to the third axis 46. In general, the second imaginary plane 70 is oriented at an angle of 15° or less with respect to the first imaginary plane 68. Preferably, this angle is between 5° and 10°. As shown in FIG. 3, it is believed that the most preferred angle is approximately 7.8°.

The seat also comprises an interior surface 72, i.e., generally confronting the third axis 46. The surface 72 comprises a first portion 74 that is proximate the inlet rim 64, a second portion 76 that is proximate the outlet rim 66, and a third portion 78 that connects the first and second portions 74, 76. The first portion 74 has a substantially constant transverse cross-section with respect to the third axis 46. The second portion 76 tapers in toward the third axis 46 from the second rim 66 to the third portion 78. As shown in FIG. 3, it is believed that the most preferred included angle of this taper is approximately 22.9°. Thus, the angle of this taper with respect to the third axis 46 is approximately 11.5°, and a ratio of this taper angle to the angle of the second imaginary plane 70 is approximately 1.5:1. The third portion 78 provides a seating surface surrounding a transverse cross-sectional area of the passage 44. As shown in FIG. 3, it is believed that the third portion 78 tapers at a most preferred angle of 45° with respect to the third axis 46. The surface 72 may also include a chamfer 80 connecting the first portion 74 to the inlet rim 64.

Referring again to FIG. 2, a valve 90 comprises a head 92, a stem 94, and is disposed coaxially with the third axis 46 within body 22. The head 92 is shown seated on the third portion 78, i.e., in a closed configuration, which closes passage 30 and prohibits exhaust gas flow between inlet and outlet ports 32,34. The valve 90 is movable, e.g., reciprocal along the third axis 46, to separate the head 92 from the third portion 78, i.e., to an open configuration, that permits the exhaust gas flow through the passage 30 between inlet and outlet ports 32,34.

Fluid-pressure-operated actuator 24 comprises a body 100 that is connected to the valve body 22 and is coaxial with the third axis 46. The actuator body 100 comprises a first body part 102 and a second body part 104. The first body part 102 comprises sheet metal formed to a generally circular shape having a central through-hole 106 that allows the actuator 24 to operatively engage the stem 94. An annular gasket 108 is sandwiched between the first body part 102 and the valve body 22.

The body 100 comprises an interior that is divided into two chamber spaces 110,112 by a movable actuator wall 114. Movable actuator wall 114 is operatively connected to the stem 94 and comprises an inner formed metal part 116 and an outer flexible part 118. Part 118 has a circular annular shape including a convolution 118*c* that rolls as wall 114 moves. Part 118 also has a bead 120 extending continuously around its outer margin. The outer margin of second body part 104 comprises a shoulder 122, and bead 120 is held compressed between first and second body parts 102,104 by an outer margin 124 of body part 102 being folded around and crimped against shoulder 122, thereby securing parts 100, 102, and 118 in assembly and sealing the outer perimeters of chamber spaces 110 and 112. The inner margin of part 118 is insert-molded only to the outer margin of part 116 to create a fluid-tight joint, uniting the two parts.

Part 116 is constructed to provide a seat 126 for seating an axial end of a helical coil compression spring 128 that is disposed within chamber space 110. Body part 104 comprises a central tower 130 and includes an integral circular wall 132 for seating the opposite end of spring 128. In this way spring 128 biases the movable wall 114 along the third axis 46 to urge valve 90 toward the third portion 78, i.e., toward the closed configuration.

A conduit 82 extends through the valve body 22 along a fourth central axis 84 and is in fluid communication with the passage 30 at a differential pressure sensing port 86. As shown in FIG. 2, the fourth axis 84 can be coaxial with the second axis 42, and consequently also lie in the same one of the parallel planes as the second axis 42. Thus, the conduit 82 can also connect with the third passage portion 44 at the second point 50 along the third axis 46.

Figure 5:
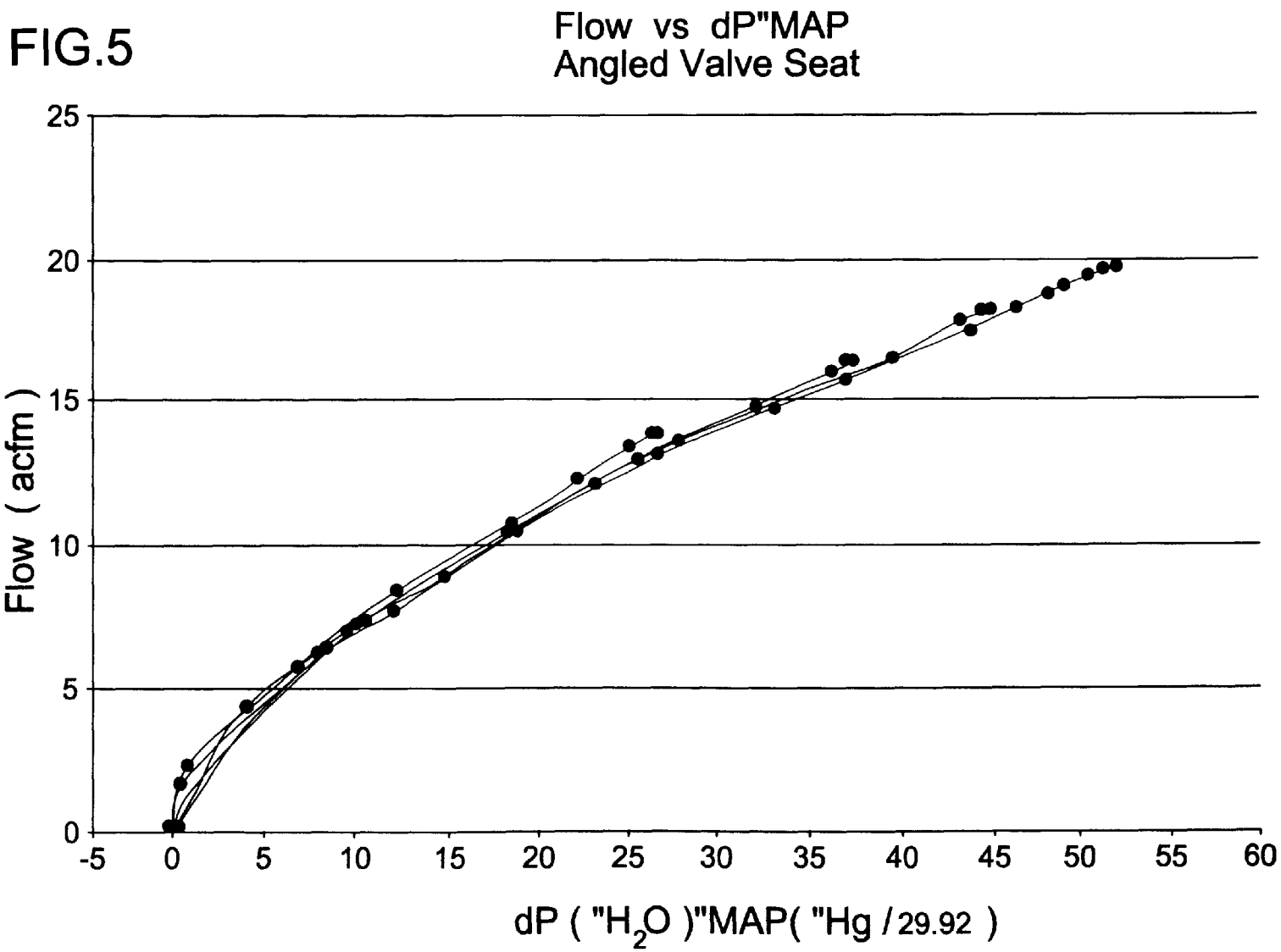
FIG. 5 is graph similar to FIG. 1 illustrating that the "curl back" characteristic of the exhaust gas flow is eliminated by the EGR valve shown in FIG. 2.

Referring additionally to FIG. 5, the "curl back" characteristic of the conventional EGR valve has been eliminated. Thus, DP*MAP increases as the exhaust gas flow increases, i.e., there is a unique value for the exhaust gas flow that can be determined for every DP*MAP. This is achieved by the oblique orientation of the outlet rim 66 with respect to the third axis 46, and by the angular orientation of the seat 60 with respect to the third axis 46. A manifestation of these two features is that the second imaginary plane 70 and the second parallel plane containing the second axis 42 intersect at a line that perpendicularly intersects the second axis 42 as it extends from the third axis 46 through the outlet port 34. In other words, the seat 60 is oriented around the axis 46 such that the greatest longitudinal length of the outlet rim 66 from the inlet rim 64 is closest to the outlet port 34. This greatest longitudinal length may also be considered to be the smallest distance of the outlet rim 66 from the second axis 42.

By virtue of the configuration and orientation of the seat 60 according to the claimed invention, the flow of exhaust gases from an I.C.E. manifold, through the ESM 20, and to an I.C.E. intake manifold is such that DP*MAP that is calculated from measuring DP at the differential pressure sensing port 86 no longer exhibits the "curl back" characteristic. This is because (1) the outlet rim 66 of the seat 60 is at an angle relative to the first imaginary plane 68, which is orthogonal to the third axis 46, and (2) the high point of the seat 60 is closest to the outlet port 34 and on the side of the valve body 22 that is opposite, with respect to the third axis 46, the differential sensing port 86.

The preferred embodiments shown in FIGS. 2–5 and described above provide a method of recirculating an exhaust gas flow from an exhaust port to an intake port of an internal combustion engine. The method includes providing a valve regulating the exhaust gas flow, and flowing the exhaust gas flow through the seat 60 such that a multiplication product of manifold absolute pressure and differential pressure on opposite sides of the valve increases as the exhaust gas flow increases.

The preferred embodiment further provides a method that includes providing a valve interposed between the exhaust and intake ports; measuring a differential pressure on opposite sides of the valve; measuring a manifold absolute pressure in the intake manifold; calculating a multiplication product of the differential pressure and the manifold absolute pressure; and determining a unique value of the exhaust gas flow for every multiplication product.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What is claimed is:

1. An emission control module comprising:

a valve body having a passage connecting a first port to a second port, the passage having a first passage portion extending from the first port along a first central axis, a second passage portion extending from the second port along a second central axis, and a third passage portion extending along a third central axis, the third passage portion connecting the first and second passage portions at respective first and second points along the third axis; and a seat extending along the third central axis and located between the first and second points, the seat having a first rim lying in a first plane oriented orthogonally with respect to the third central axis and a second rim lying in a second plane oriented obliquely with respect to the third central axis.

2. The emission control module according to claim 1, wherein the first and second axes lie in respective parallel planes that are orthogonal to the third central axis, and the first and second points are separated along the third central axis.

3. The emission control module according to claim 2, wherein an intersection of the second plane and the parallel plane including the second axis defines a line that is perpendicular to the second axis, and the line intersects a portion of the second axis that extends from the second point through the second port.

4. The emissions control module according to claim 3, wherein the valve body also has a conduit extending along a fourth central axis, and the conduit is in fluid communication with the second passage portion.

5. The emissions control module according to claim 4, wherein the conduit connects to the second passage portion at the second point.

6. The emissions control module according to claim 4, wherein the fourth central axis lies in the parallel plane including the second axis.

7. The emissions control module according to claim 6, wherein the second, third, and fourth central axes lie in a common plane, and the second and fourth central axes are coaxial.

8. An exhaust gas recirculation passage for an internal combustion engine, the passage comprising:

an inlet;

an outlet; and an orifice between the inlet and the outlet, the orifice defining a portion of the passage and extending along a central axis between a first rim and a second rim, the first rim lying in a first plane oriented orthogonally with respect to the central axis, and the second rim lying in a second plane oriented obliquely with respect to the central axis.

9. The passage according to claim 8, wherein the orifice comprises a surface connecting the first rim to the second rim, and the surface generally confronts the central axis.

10. The passage according to claim 9, wherein the surface comprises a first portion proximate the first rim and a second portion proximate the second rim, the first portion generally has a substantially constant cross-section, and the second portion tapers in at a first angle with respect to the third central axis from the second rim toward the first portion.

11. The passage according to claim 10, wherein the second plane is oriented with respect to first plane at a second angle, and a ratio of the first angle to the second angle is approximately 1.5:1.

12. The passage according to claim 10, wherein the surface further comprises a third portion connecting the first and second portions, the third portion tapering between the second and first portions at a third angle that is greater than the first angle.

13. The passage according to claim 12, wherein the surface further comprises a chamfer connecting the first portion to the first rim.

14. The passage according to claim 8, wherein the second plane is oriented with respect to the first plane at an angle less than 15°.

15. The passage according to claim 14, wherein the angle is between 5° and 10°.

16. A method of recirculating an exhaust gas flow from an exhaust port to an intake port of an internal combustion engine, the method comprising:

providing a valve regulating the exhaust gas flow, the valve including a body defining a passage between an inlet port and an outlet port, the body including:

a seat disposed along the passage, the seat having a rim providing an outlet for the exhaust gas flow through the seat, the rim lying in a plane that is oriented obliquely with respect to a first axis; and a valve movable with respect to the seat, the valve reciprocating along the first axis between a first configuration prohibiting the exhaust gas flow through the seat and a second configuration permitting the exhaust gas flow through the seat; and flowing the exhaust gas flow through the seat such that a multiplication product of manifold absolute pressure and differential pressure on opposite sides of the valve increases as the exhaust gas flow increases.

17. The method according to claim 16, wherein a portion of the passage connected to the outlet port extends along a second axis perpendicular to the first axis, and wherein the seat is oriented in the passage such that a smallest distance between the rim and the second axis is closest to the outlet port.

18. A method of recirculating exhaust gas flow from an exhaust port to an intake port of an internal combustion engine, the method comprising:

providing a valve interposed between the exhaust and intake ports;

measuring a differential pressure on opposite sides of the valve;

measuring a manifold absolute pressure in the intake manifold, calculating a multiplication product of the differential pressure and the manifold absolute pressure; and determining a unique value of the exhaust gas flow for every multiplication product.

19. The method according to claim 18, wherein the providing the valve comprises providing:

a valve body having a passage connecting a first port to a second port, the passage having a first passage portion extending from the first port along a first central axis, a second passage portion extending from the second port along a second central axis, and a third passage portion extending along a third central axis, the third passage portion extending orthogonally with respect to the first and second passage portions and connecting the first and second passage portions at respective first and second points separated along the third axis; and a seat extending along the third passage portion, the seat having a first rim lying in a first plane oriented orthogonally with respect to the third central axis, and the second rim lying in a second plane oriented obliquely with respect to the third central axis.

* * * * *